US010030668B2

(12) United States Patent
Kojima et al.

(10) Patent No.: US 10,030,668 B2
(45) Date of Patent: Jul. 24, 2018

(54) AXIAL-FLOW FAN

(71) Applicant: DAIKIN INDUSTRIES, LTD., Osaka-shi, Osaka (JP)

(72) Inventors: Azumi Kojima, Sakai (JP); Yuuta Yokoyama, Kyoto (JP)

(73) Assignee: Daikin Industries, Ltd., Osaka (JP)

( * ) Notice: Subject to any disclaimer, the term of this patent is extended or adjusted under 35 U.S.C. 154(b) by 1067 days.

(21) Appl. No.: 14/368,221

(22) PCT Filed: Dec. 26, 2012

(86) PCT No.: PCT/JP2012/083576
§ 371 (c)(1),
(2) Date: Jun. 23, 2014

(87) PCT Pub. No.: WO2013/099905
PCT Pub. Date: Jul. 4, 2013

(65) Prior Publication Data

US 2015/0003992 A1 Jan. 1, 2015

(30) Foreign Application Priority Data

Dec. 28, 2011 (JP) ..... 2011-288206

(51) Int. Cl.
*F04D 29/32* (2006.01)
*F04D 29/38* (2006.01)
*F04D 29/26* (2006.01)

(52) U.S. Cl.
CPC ..... *F04D 29/329* (2013.01); *F04D 29/263* (2013.01); *F04D 29/38* (2013.01); *F04D 29/384* (2013.01); *F05D 2240/304* (2013.01)

(58) Field of Classification Search
CPC ..... F04D 29/329; F04D 29/263; F04D 29/38; F04D 29/384; F05D 2240/304
See application file for complete search history.

(56) References Cited

U.S. PATENT DOCUMENTS 5,244,347 A * 9/1993 Gallivan ..... F04D 19/002 415/208.2
5,906,179 A * 5/1999 Capdevila ..... F04D 29/326 123/41.49

(Continued)

FOREIGN PATENT DOCUMENTS

EP 1 895 165 A1 3/2008
JP 2-145698 U 12/1990

(Continued)

OTHER PUBLICATIONS

Machine Translation of JP 2003232296 [retrieved on Dec. 4, 2017]. Retrieved from: Espacenet.*

(Continued)

*Primary Examiner* — Igor Kershteyn
*Assistant Examiner* — Eric Zamora Alvarez
(74) *Attorney, Agent, or Firm* — Global IP Counselors, LLP

(57) ABSTRACT

An axial-flow fan includes a boss and a plurality of blades integrally resin-molded with a hub. An axial hole of the boss has a shaft of a drive motor inserted. The axial hole is formed at an axial center of the hub. The hub includes an outer perimeter cylinder and a lid. The outer perimeter cylinder has an opening formed at the axial center, and the blades are formed so as to project from the outer perimeter cylinder. The lid extends from the outer perimeter cylinder toward the boss so as to cover the opening of the outer perimeter cylinder. The lid connects the boss and the outer perimeter cylinder together. Reinforcing ribs are integrally resin-molded together with the hub and the boss on both axial-direction sides of the lid. The reinforcing ribs reinforce the connection between the hub and the boss.

8 Claims, 14 Drawing Sheets

(56) References Cited

U.S. PATENT DOCUMENTS

| | | | | |
|---|---|---|---|---|
| 6,579,063 | B2 * | 6/2003 | Stairs | F04D 29/326 416/169 A |
| 7,762,769 | B2 * | 7/2010 | Stevens | F04D 29/326 415/220 |
| 2011/0135494 | A1 * | 6/2011 | Nicgorski | F04D 29/329 416/93 R |

FOREIGN PATENT DOCUMENTS

| | | | |
|---|---|---|---|
| JP | 5-340383 | A | 12/1993 |
| JP | 2000-170691 | A | 6/2000 |
| JP | 2002-5085 | A | 1/2002 |
| JP | 2002-502473 | A | 1/2002 |
| JP | 2003-232296 | A | 8/2003 |
| JP | 2003-286997 | A | 10/2003 |
| JP | 2003-343488 | A | 12/2003 |
| JP | 2008-51035 | A | 3/2008 |
| JP | 2008-51036 | A | 3/2008 |
| JP | WO2008/072516 | A1 | 6/2008 |
| JP | 2011-74817 | A | 4/2011 |
| WO | 2006/062185 | A1 | 6/2006 |

OTHER PUBLICATIONS

International Search Report of corresponding PCT Application No. PCT/JP2012/083576.
International Preliminary Report of corresponding PCT Application No. PCT/JP2012/083576 dated Jul. 10, 2014.
European Search Report of corresponding EP Application No. 12 86 2012.7 dated Oct. 27, 2014.

* cited by examiner

AXIAL-FLOW FAN

CROSS-REFERENCE TO RELATED APPLICATIONS

This U.S. National stage application claims priority under 35 U.S.C. § 119(a) to Japanese Patent Application No. 2011-288206, filed in Japan on Dec. 26, 2011, the entire contents of which are hereby incorporated herein by reference.

TECHNICAL FIELD

The present invention relates to an axial-flow fan, and relates in particular to an axial-flow fan in which a boss and a plurality of blades are integrally resin-molded with a hub, an axial hole through which a drive motor shaft is inserted being formed in the boss in the axial center of the hub.

BACKGROUND ART

In the past, there have been axial-flow fans in which a boss and a plurality of blades are integrally resin-molded with a hub, an axial hole through which a drive motor shaft is inserted being formed in the boss in the axial center of the hub, such as those shown in Japanese Laid-open Patent Application No. H5-340383 and Japanese Laid-open Patent Application No. 2011-74817. The hub herein has an outer perimeter cylinder and a lid. The outer perimeter cylinder is a portion having an opening in the axial center, a plurality of blades being formed so as to project from the outer perimeter edge. The lid, which extends from the outer perimeter cylinder toward the boss so as to cover the opening of the outer perimeter cylinder, is a portion for connecting the boss and the outer perimeter cylinder together. Specifically, the boss is connected to the outer perimeter cylinder and integrated with the hub by the lid. Reinforcing ribs are also formed between the hub and the boss.

SUMMARY

In the above-described conventional axial-flow fan, there is sometimes insufficient connection strength between the hub and the boss.

An object of the present invention is to improve the connection strength between the hub and the boss in an axial-flow fan in which a boss and a plurality of blades are integrally resin-molded with a hub, an axial hole through which a drive motor shaft is inserted being formed in the boss in the axial center of the hub.

An axial-flow fan according to a first aspect is an axial-flow fan having blades in which a boss and a plurality of blades are integrally resin-molded with a hub, an axial hole through which a drive motor shaft is inserted being formed in the boss in the axial center of the hub. The hub has an outer perimeter cylinder and a lid. The outer perimeter cylinder is a portion having an opening in the axial center, the blades being formed so as to project from the outer perimeter edge. The lid is a portion extending from the outer perimeter cylinder toward the boss so as to cover the opening of the outer perimeter cylinder, and connecting the boss and the outer perimeter cylinder together. Reinforcing ribs for reinforcing the connection between the hub and the boss are integrally resin-molded together with the hub and the boss on both axial-direction sides of the lid.

In a conventional axial-flow fan, reinforcing ribs are formed between the hub and the boss but the reinforcing ribs are formed on only one axial-direction side of the lid. This is a cause of the connection strength between the hub and the boss being insufficient.

In view of this, in this axial-flow fan, reinforcing ribs are formed on the both axial-direction sides of the lid as described above.

It is thereby possible in this axial-flow fan to strengthen the reinforcement between the hub and the boss, and to improve the connection strength between the hub and the boss.

An axial-flow fan according to a second aspect is the axial-flow fan according to the first aspect, wherein the lid extends toward the inner perimeter and in the axial direction from the outer perimeter cylinder. The reinforcing ribs have outer perimeter reinforcing ribs for connecting the outer perimeter cylinder and the lid together, and inner perimeter reinforcing ribs for connecting the lid and the boss together.

In this axial-flow fan, the lid extends toward the inner perimeter and in the axial direction from the outer perimeter cylinder. Therefore, a space is formed diametrally between the lid and the outer perimeter cylinder on one axial-direction side of the lid, and another space is formed diametrally between the boss and the lid on the other axial-direction side of the lid. The outer perimeter reinforcing ribs are formed in the space on the first axial-direction side of the lid, and the inner perimeter reinforcing ribs are formed in the space on the other axial-direction side of the lid.

It is thereby possible in this axial-flow fan to strengthen the reinforcement between the hub and the boss by means of two types of reinforcing ribs formed on the both axial-direction sides of the lid.

An axial-flow fan according to a third aspect is the axial-flow fan according to the second aspect, wherein the boss extends from the inner perimeter edge of the lid toward the side near the drive motor. A washer fitting part includes a concavity into which a washer for stopping the rotation of the shaft is fitted, and is formed in an end surface of the boss on the side further from the drive motor.

In this axial-flow fan, because the washer fitting part is formed in the end surface of the boss on the side further from the drive motor, there is a portion of little thickness in the vicinity of the end surface on the side of the boss further from the drive motor. Therefore, in this axial-flow fan, the connecting portion between the boss and the inner perimeter edge of the lid is likely to lose strength.

However, in this axial-flow fan, the reinforcement between the boss and the lid is strengthened by the inner perimeter reinforcing ribs as described above.

It is thereby possible in this axial-flow fan to achieve sufficient connection strength between the boss and the lid, despite the connecting portion between the boss and the inner perimeter edge of the lid being likely to lose strength.

An axial-flow fan according to a fourth aspect is the axial-flow fan according to the second or third aspect, wherein pluralities of both the outer perimeter reinforcing ribs and the inner perimeter reinforcing ribs are disposed at intervals in the circumferential direction.

An axial-flow fan according to a fifth aspect is the axial-flow fan according to the fourth aspect, wherein a thin-walled boss part is formed in the outer perimeter portion of the axial hole of the boss so that a plurality of columnar ribs are left at intervals in the circumferential direction.

In this axial-flow fan, the transmission of vibrations such as cogging sounds from the boss to the hub can be mitigated by the plurality of columnar ribs. Specifically, the plurality of columnar ribs function is a vibration-absorbing structure of the axial-flow fan.

It is thereby possible in this axial-flow fan to minimize noises caused by vibrations such as cogging sounds.

An axial-flow fan according to a sixth aspect is the axial-flow fan according to the fifth aspect, wherein the columnar ribs are disposed in the same circumferential direction positions as the inner perimeter reinforcing ribs.

In this axial-flow fan, the columnar ribs together with the inner perimeter reinforcing ribs function as integrated reinforcing ribs for diametrally supporting the boss and the lid.

It is thereby possible in this axial-flow fan for the boss and the lid to be connected together more firmly.

An axial-flow fan according to a seventh aspect is the axial-flow fan according to any of the fourth through sixth aspects, wherein the outer perimeter reinforcing ribs are disposed between the inner perimeter reinforcing ribs in the circumferential direction.

DESCRIPTION OF EMBODIMENTS

An embodiment of the axial-flow fan according to the present invention is described below based on the accompanying drawings. The specific configuration of the axial-flow fan according to the present invention is not limited to the embodiment below, and modifications are possible within a scope not deviating from the main point of the present invention. In the description below, an example in which the present invention is applied to an axial-flow fan configuring an outdoor unit is described, but the present invention is not limited to this; it may be applied to an axial-flow fan for another use.

(1) Overall Configuration of the Outdoor Unit

Figure 1:
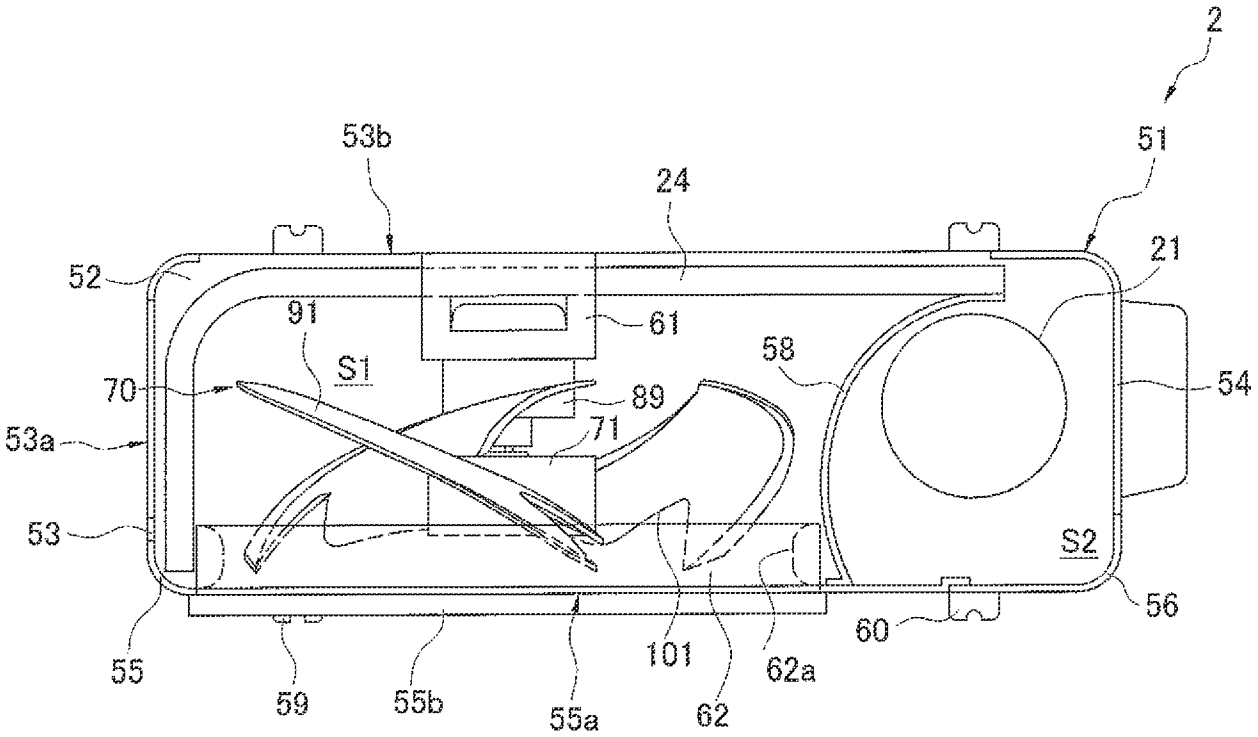
FIG. 1 is a plan view showing a state in which a ceiling plate has been removed from an outdoor unit in which an outdoor fan is used as an axial-flow fan according to an embodiment of the present invention.
Figure 2:
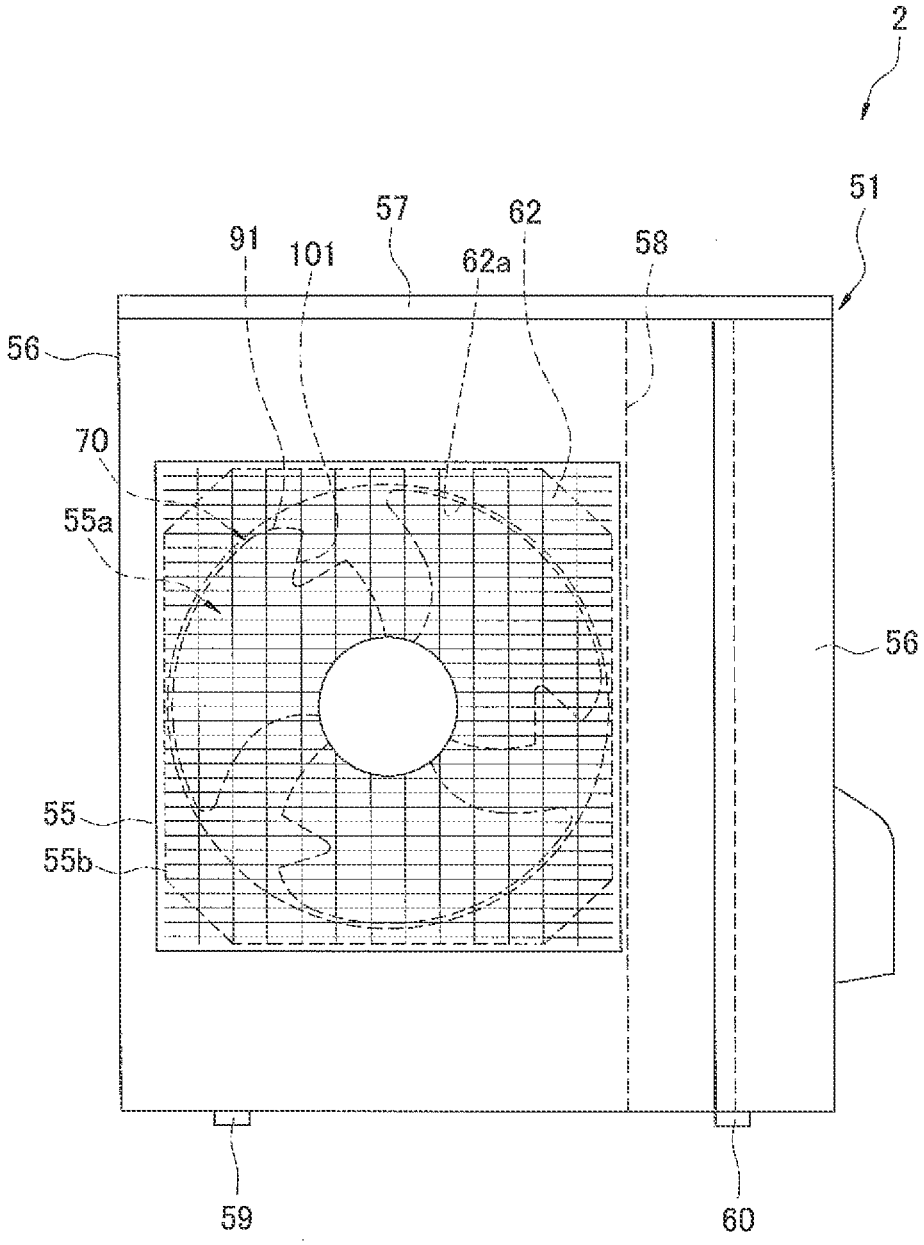
FIG. 2 is a front view of the outdoor unit in which the outdoor fan according to an embodiment of the present invention is used.

FIGS. 1 and 2 are drawings illustrating an outdoor unit 2 of an air conditioning apparatus in which is adopted an outdoor fan 70 as an axial-flow fan according to one embodiment of the present invention. Here, FIG. 1 is a plan view of the outdoor unit 2 in a condition having removed a ceiling plate 57. FIG. 2 is a front view of the outdoor unit 2. In the description below, words expressing directions and/or faces including "up," "down," "left," and "right," and/or "front face," "side face," "back face," "top face," and "bottom face," unless otherwise specified, signify directions and/or faces in the case of regarding the outdoor unit 2 illustrated in FIG. 2 as a front face.

The outdoor unit 2 has a structure (so called "trunk-type" structure), in which an internal space of a unit casing 51 is divided into left and right by a partitioning plate 58 extending in a vertical direction, whereby a blower compartment S1 and a machine compartment S2 are formed. The outdoor unit 2 is configured so that outside air is taken into the unit casing 51 from a back face and one part of a side face of the unit casing 51 and the outside air is blown out from a front face of the unit casing 51. The outdoor unit 2 mainly has the unit casing 51, refrigerant circuit-configuring parts including a compressor 21, an outdoor heat exchanger 24, and refrigerant pipes connecting these machines, an outdoor fan 70 (axial-flow fan), and a bell mouth 62. Here, an example is described, in which the blower compartment S1 is formed toward a left side face of the unit casing 51 and the machine compartment S2 is formed toward a right side face of the unit casing 51, but left and right may be reversed.

The unit casing 51 is formed in a roughly rectangular parallelepiped form, and mainly houses the refrigerant circuit-configuring parts including the compressor 21, the outdoor heat exchanger 24, and refrigerant pipes connecting these machines, and the outdoor fan 70. The unit casing 51 has a floor plate 52, a blower compartment-side side plate 53, a machine compartment-side side part 54, a blower compartment-side front plate 55, a machine compartment-side front plate 56, and a ceiling plate 57.

The floor plate 52 is a metal plate-form member configuring a bottom face of the unit casing 51. Two foundation legs 59 and 60 fixed to a site installation surface are provided beneath the floor plate 52.

The blower compartment-side side plate 53 is a metal plate-form member configuring a side face portion toward the blower compartment S1 of the unit casing 51. A lower part of the blower compartment-side side plate 53 is fixed to the floor plate 52. An intake port 53*a* for outside air taken into the unit casing 51 by the outdoor fan 70 is formed on the blower compartment-side side plate 53.

The machine compartment-side side plate 54 is a metal plate-form member configuring one part of a side face portion toward the machine compartment S2 of the unit casing 51 and a back face portion toward the machine compartment S2 of the unit casing 51. A lower part of the machine compartment-side side plate 54 is fixed to the floor plate 52. Here, the machine compartment-side side plate 54 covers a portion toward the back face of the side face of the machine compartment S2. An intake port 53*b* for outside air taken into the unit casing 51 by the outdoor fan 70 is formed between an end part on the back face side of the blower compartment-side side plate 53 and an end part on the blower compartment S1 side of the machine compartment-side side plate 54.

The blower compartment-side front plate 55 is a metal plate-form member configuring a front face portion of the blower compartment S1 of the unit casing 51 and one part of a front face portion of the machine compartment S2 of the unit casing 51. A blow-out port 55*a* for blowing out outside air taken into the unit casing 51 to the outside by the outdoor fan 70 is provided on the blower compartment-side front plate 55. A front side of the blow-out port 55*a* is covered by a fan grill 55*b*. A lower part of the blower compartment-side front plate 55 is fixed to the floor plate 52, and an end part on the left side face side thereof is fixed to an end part on the front face side of the blower compartment-side side plate 53.

The machine compartment-side front plate 56 is a metal plate-form member that is removed during test running and/or maintenance in order to access the machine compartment S2 from the front face side of the unit casing 51 and perform inspection, and the like, of the machines disposed inside the machine compartment S2. The machine compartment-side front plate 56 is a metal plate-form member configuring one part of a front face portion of the machine compartment S2 of the unit casing 51 and one part of a side face portion of the machine compartment S2 of the unit casing 51. An end part on the blower compartment S1 side of the machine compartment-side front plate 56 is fixed to an end part on the machine compartment S2 side of the blower compartment-side front plate 55, and an end part on a back face side thereof is fixed to an end part on the front face side of the machine compartment-side side plate 54. Here, one part of the front face portion of the machine compartment S2 of the unit casing 51 is configured by the blower compartment-side front plate 55, but that part may be configured by the machine compartment-side front plate 56. The blower compartment-side front plate 55 and the machine compartment-side front plate 56 also may be an integrated member.

The ceiling plate 57 is a metal plate-form member configuring a top face portion of the unit casing 51. The ceiling plate 57 is fixed to the blower compartment-side side plate 53, the machine compartment-side side plate 54, and the blower compartment-side front plate 55.

The partitioning plate 58 is a metal plate-form member being disposed on the floor plate 52 and extending in a vertical direction. The partitioning plate 58 divides the internal space of the unit casing 51 into left and right to form the blower compartment S1 toward the left side face and the machine compartment S2 toward the right side face. The partitioning plate 58 has a shape that is curved so that a central portion in a front-to-back direction thereof projects toward the blower compartment S1 side. A lower part of the partitioning plate 58 is fixed to the floor plate 52, an end part on a front face side thereof is fixed to the blower compartment-side front plate 55, and an end part on a back face side thereof is fixed to an end part on the machine compartment S2 side of the outdoor heat exchanger 24.

The outdoor fan 70 is a propeller type axial-flow fan mainly with which a hub 71 and a plurality of (here, three) blades 91 are integrally resin-molded, the plurality of blades 91 being formed so as to project from an outer perimeter edge of the hub 71. The outdoor fan 70 is provided so as to face opposite the front face of the unit casing 51 inside the blower compartment S1. More specifically, the outdoor fan 70 is provided so as to face opposite the blow-out port 55*a* formed on the blower compartment-side front plate 55 in a position on the front face side of the outdoor heat exchanger 24. Here, a recessed part 101 recessed toward a front edge side of the blade 91 is formed in a rear edge of the blade 91, for the purpose of improvement of ventilating performance and/or suppression of noise. The outdoor fan 70 is driven to rotate by a fan motor 89 disposed between the outdoor fan 70 and the outdoor heat exchanger 24 in the front-to-back direction. The fan motor 89 is supported by a fan motor mount 61 extending in a vertical direction between the ceiling plate 57 and the floor plate 52. A detailed configuration of the outdoor fan is to be described.

The bell mouth 62 is a member having a bell-shaped opening 62*a* having an open center, and is provided on the outer perimeter side of the outdoor fan 70. That is, the bell mouth 62 is provided so as to face opposite the front face of the unit casing 51 in the same manner as the outdoor fan 70 inside the blower compartment S1, and the outer perimeter of the outdoor fan 70 is surrounded by the opening 62*a*. The bell mouth 62 is fixed to the front face of the unit casing 51. A portion of the bell mouth 62 toward the blower compartment-side side plate 53 is disposed proximally to a front-side end of the outdoor heat exchanger 24. A portion of the bell mouth 62 toward the machine compartment S1 is disposed proximally to the partitioning plate 58.

The outdoor heat exchanger 24 is a roughly L-shaped heat exchanger panel, and is disposed on the floor plate 52 so as to follow the left side face and the back face of the unit casing 51 inside the blower compartment S1.

The compressor 21 is a sealed-type compressor having an upright cylindrical shape, and is disposed inside the machine compartment S2.

Although not illustrated here, the machines, refrigerant pipes, and/or other refrigerant circuit-configuring parts in addition to the compressor 21 also are disposed inside the machine compartment S2.

(2) Detailed Configuration of Outdoor Fan

Figure 3:
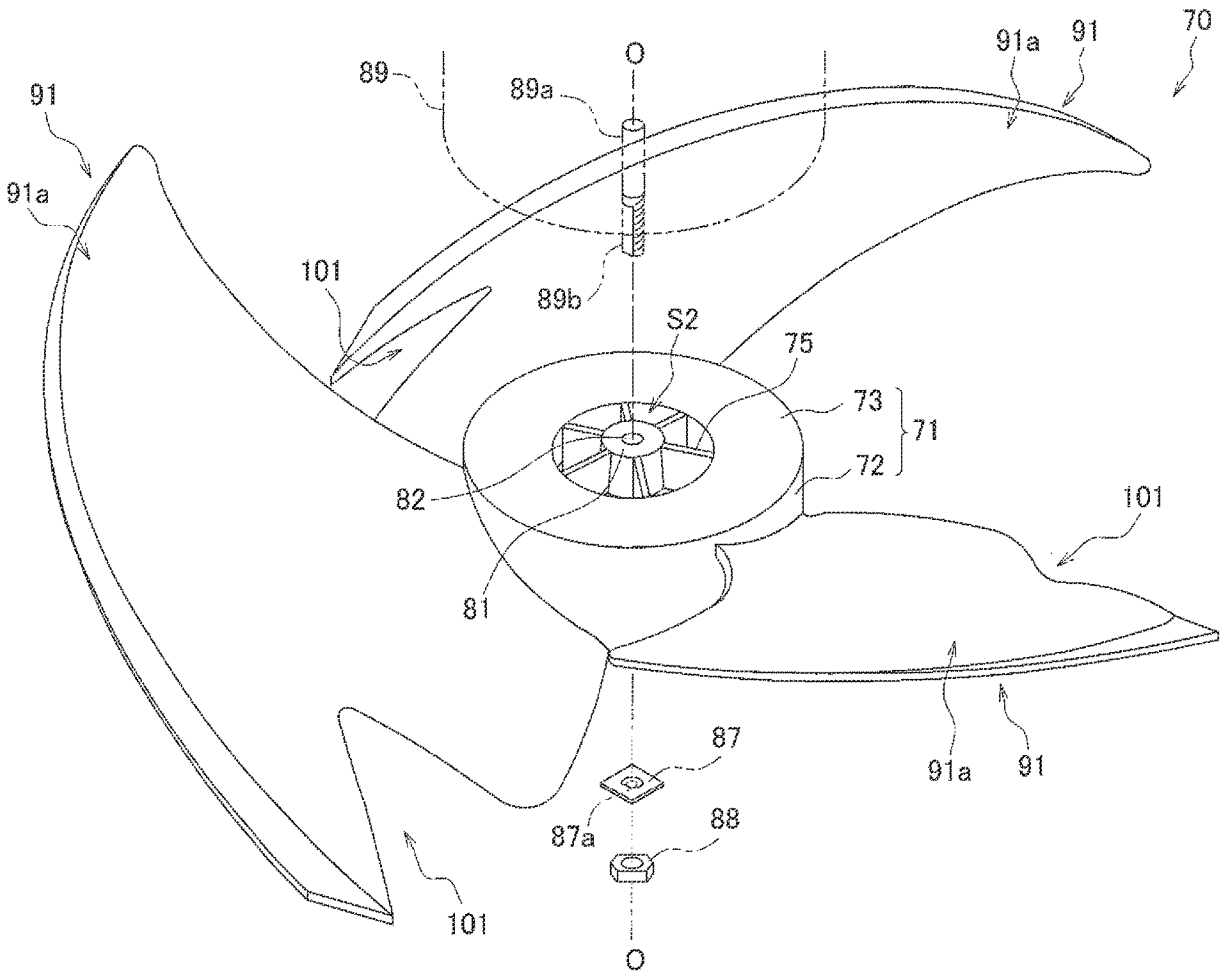
FIG. 3 is a perspective view of the outdoor fan according to an embodiment of the present invention.
Figure 4:
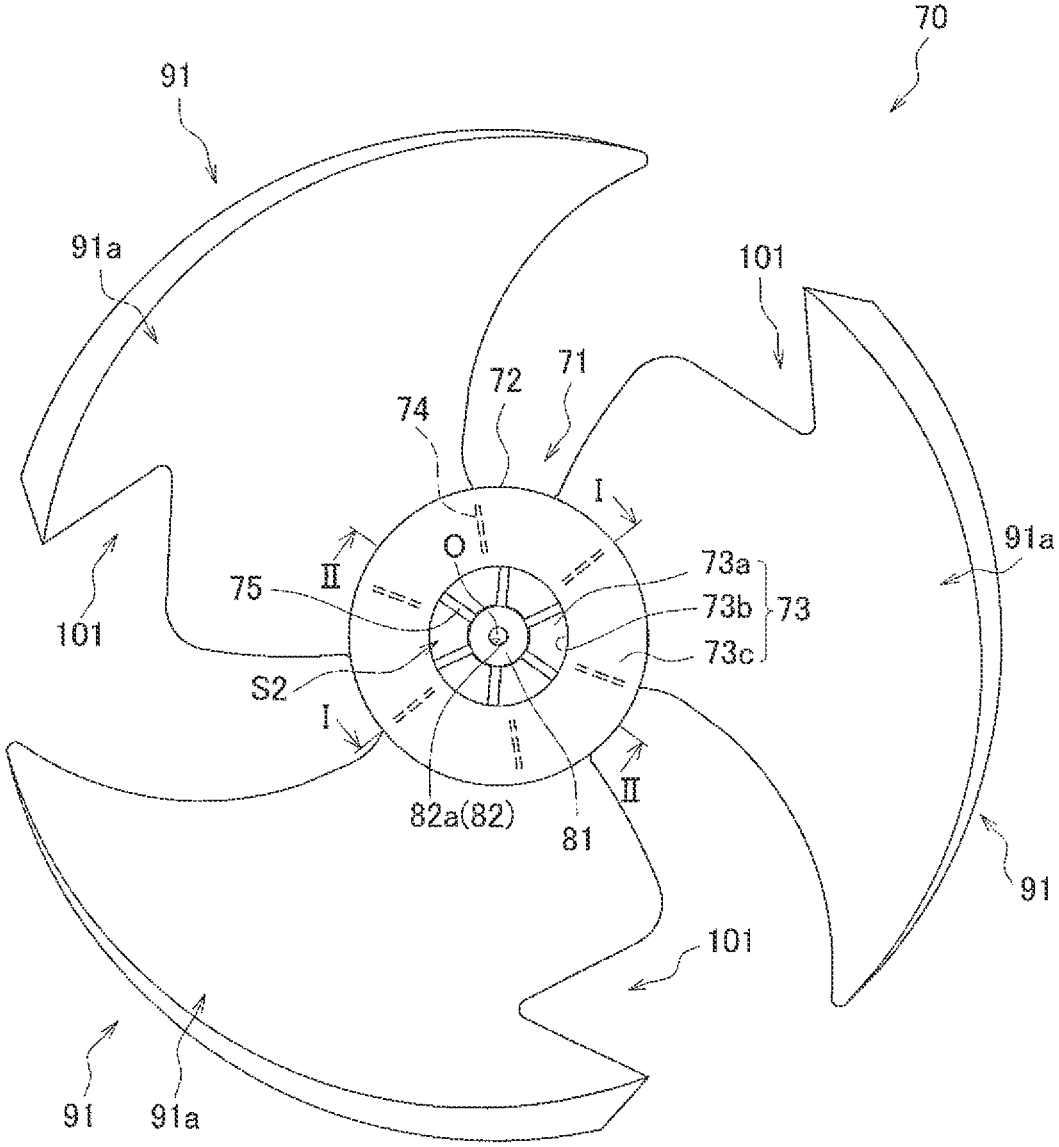
FIG. 4 is a plan view of a negative pressure surface side of the outdoor fan according to an embodiment of the present invention.
Figure 5:
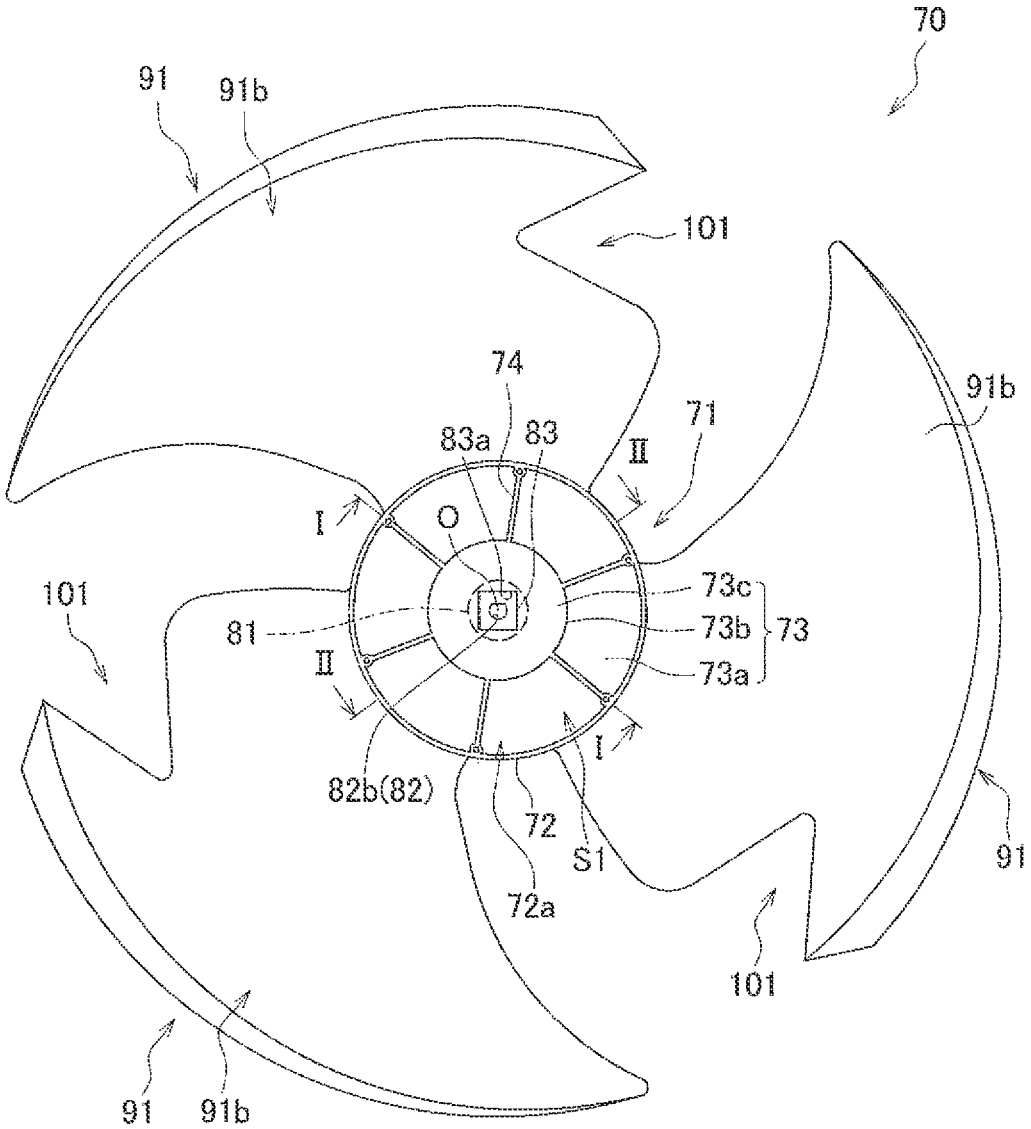
FIG. 5 is a plan view of a positive pressure surface side of the outdoor fan according to an embodiment of the present invention.
Figure 6:
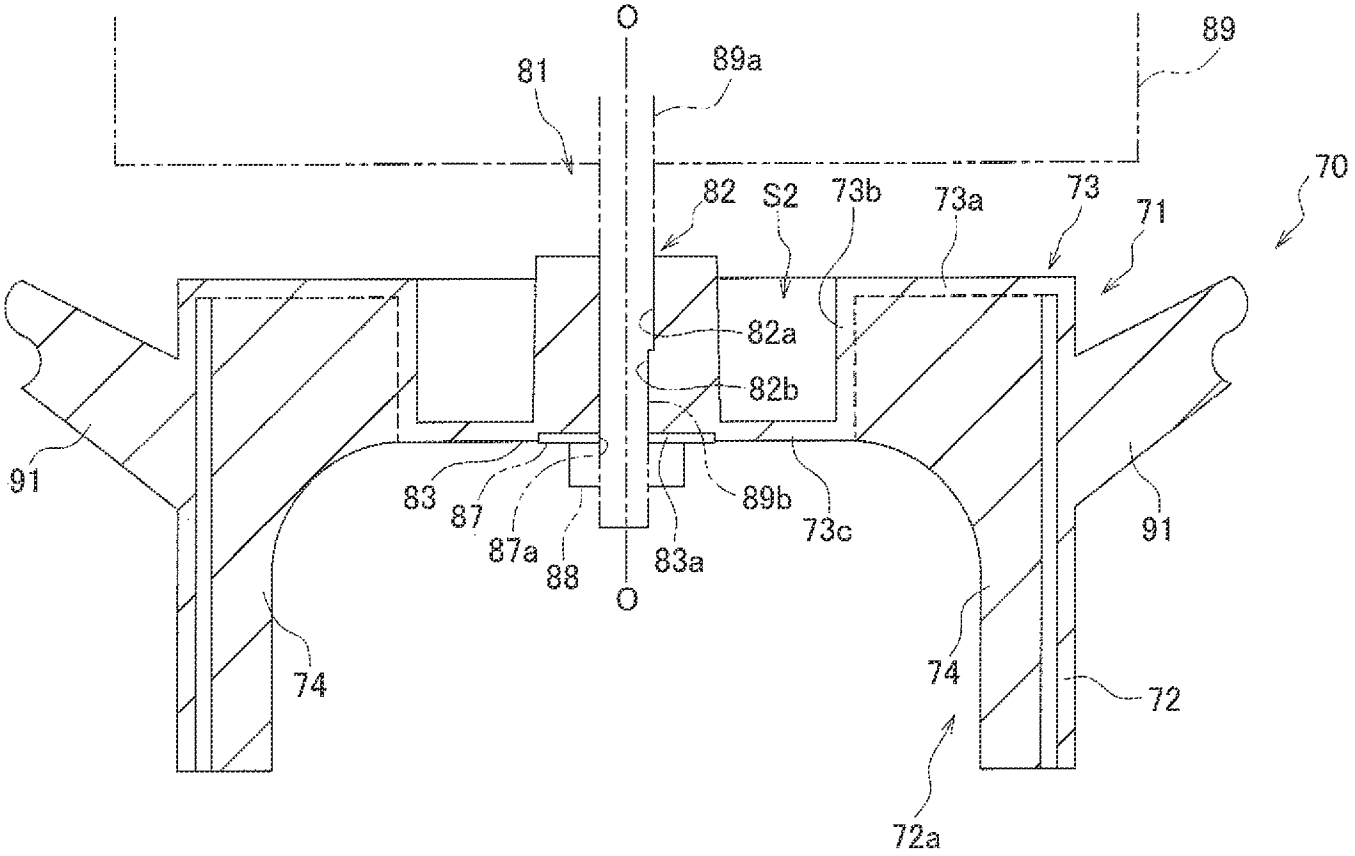
FIG. 6 is a cross-sectional view along I-I in FIGS. 4 and 5.
Figure 7:
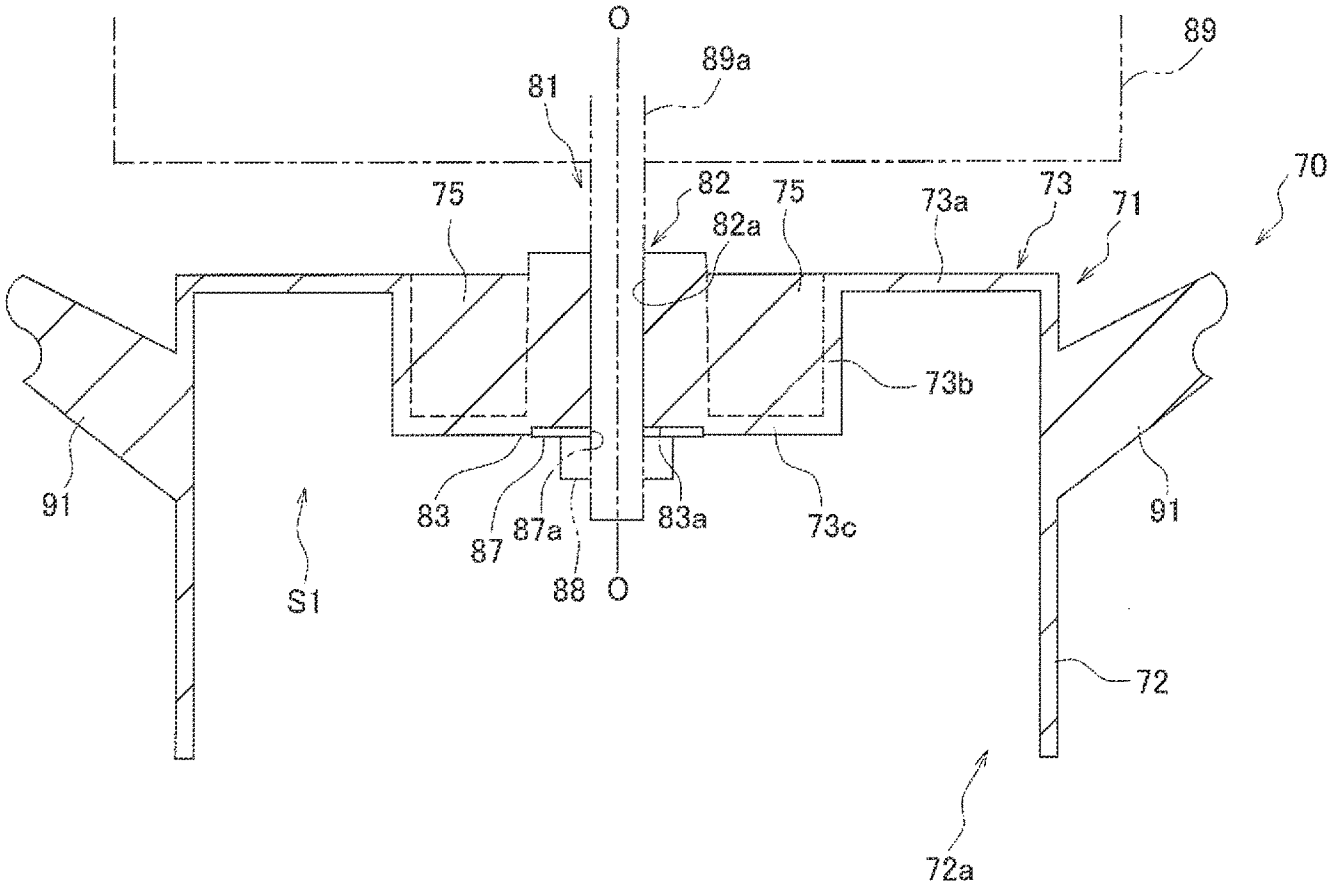
FIG. 7 is a cross-sectional view along line II-II in FIGS. 4 and 5.

Next, FIGS. 3 to 7 are used to describe the detailed configuration of the outdoor fan 70 as an axial-flow fan according to the present embodiment. FIG. 3 is a perspective view of the outdoor fan 70. FIG. 4 is a plan view of the negative pressure face side of the outdoor fan 70. FIG. 5 is a plan view of the positive pressure face side of the outdoor fan 70. FIG. 6 is a cross-sectional view along line in FIGS. 4 and 5. FIG. 7 is a cross-sectional view along II-II in FIGS. 4 and 5. In the following descriptions, the axial center (rotational center) of the outdoor fan 70 is denoted as the axial center O, and the axis line thereof is denoted as the rotational axis line O-O. The direction along the rotational axis line O-O is denoted as the axial direction, the state of the outdoor fan 70 seen from the axial direction is denoted as a plan view, and the direction orthogonal to this plan view (i.e. the direction of viewing a cross section of the outdoor fan 70 cut along the rotational axis line O-O is denoted as a cross-sectional view.

The outdoor fan 70 is a propeller fan in which primarily the hub 71 and a plurality (here, three) of the blades 91 are integrally resin-molded, the blades being formed so as to project from the outer perimeter edge of the hub 71, as described above. The number of blades 91 is not limited to three, and may be four or more, for example. In the outdoor fan 70, a boss 81 is integrally resin-molded in the hub 71, an axial hole 82 through which a shaft 89*a* of a fan motor 89 as a drive motor is inserted being formed in the boss in the axial center O of the hub 71.

The blades 91 have blade shapes that advance forward and tilt forward. The thickness of the blades 91 is greatest in the joints with the hub 71, and decreases toward the outer perimeter. The recessed part 101 formed in the rear edges of the blades 91 are disposed nearer to the outer perimeter than the joints. When the outdoor fan 70 is rotated, the surfaces of the sides where air flows in (the upstream sides in the air flow direction) are denoted as the negative pressure surfaces

91*a*, and the opposite sides (the downstream sides in the air flow direction) are denoted as the positive pressure surfaces 91*b*.

The hub 71 has primarily an outer perimeter cylinder 72 and a lid 73. The outer perimeter cylinder 72 is a portion having an opening 72*a* in the axial center O, a plurality of blades 91 being formed so as to project from the outer perimeter edge. The outer perimeter cylinder 72 herein has a cylindrical shape.

The lid 73, which extends from the outer perimeter cylinder 72 toward the boss 81 so as to cover the opening 72*a* of the outer perimeter cylinder 72, is a portion for connecting the boss 81 and the outer perimeter cylinder 72 together. Specifically, the lid 73 extends toward the inner perimeter and in the axial direction from the outer perimeter cylinder 72. The lid 73 herein has an outer perimeter plate 73*a*, an intermediate cylinder 73*b*, and an inner perimeter plate 73*c*. The outer perimeter plate 73*a* is an annular portion extending toward the inner perimeter from the outer perimeter cylinder 72. The outer perimeter plate 73*a*, which extends toward the inner perimeter from the end of the outer perimeter cylinder 72 on the fan motor 89 side in the axial direction, is joined to the intermediate cylinder 73*b*. The intermediate cylinder 73*b* is a cylindrical portion extending along the axial direction from the outer perimeter plate 73*a*. The intermediate cylinder 73*b*, which extends in a direction of moving away from the fan motor 89 from the inner perimeter edge of the outer perimeter plate 73*a*, is joined to the inner perimeter plate 73*c*. The inner perimeter plate 73*c* is an annular portion extending toward the inner perimeter from the intermediate cylinder 73*b*. The inner perimeter plate 73*c*, which extends toward the inner perimeter from the end of the intermediate cylinder 73*b* opposite to the fan motor 89 side in the axial direction, is joined to the boss 81. Specifically, the lid 73, which as a whole extends toward the inner perimeter and in the axial direction from the outer perimeter cylinder 72, is configured from the outer perimeter plate 73*a* and the inner perimeter plate 73*c* which extend toward the inner perimeter, and the intermediate cylinder 73*b* which extends in the axial direction.

The boss 81, which is a cylindrical portion in which the axial hole 82 is formed as described above, extends from the inner perimeter edge of the lid 73 (the inner perimeter plate 73*c* herein) toward a side near the fan motor 89. The portion of the axial hole 82 on the side near the fan motor 89 is a circular round hole 82*a* having an inside diameter capable of accommodating insertion of the shaft 89*a* of the fan motor 89. The portion of the axial hole 82 on the side further from the fan motor 89 is a D-shaped hole 82*b*, having a D shape capable of accommodating insertion of a D-cut part 89*b* having a D-shaped cross section formed in the tip of the shaft 89*a*. In an end surface 83 of the boss 81 on the side further from the fan motor 89 is formed a washer fitting part 83*a* including a concavity into which a washer 87 for stopping the shaft 89*a* from rotating is fitted. Specifically, with the shaft 89*a* inserted into the boss 81, the shaft is fixed to the boss 81 by threading a nut 88 in which is formed a female thread to be threaded on a male thread portion formed in the tip of the shaft 89*a*. At this time, merely with the nut 88 threaded on the shaft 89*a*, there is yet a risk of the shaft 89*a* rotating relative to the boss 81. In view of this, the D-shaped hole 82*b* is first formed in the axial hole 82 of the boss 81 as described above, and the D-cut part 89*b* of the shaft 89*a* is inserted into the D-shaped hole 82*b*. Moreover, the washer 87, in which is formed a D-shaped hole 87*a* of the same size as the D-shaped hole 82*b*, is fitted into the washer fitting part 83*a* formed in the end surface 83 on the side of the boss 81 further from the fan motor 89, and the washer 87 is prevented from rotating relative to the boss 81. The washer 87 herein has a square shape, and the washer fitting part 83*a* is a square-shaped concavity. Thus, the shaft 89*a* is stopped from rotating by the washer 87 and by the D-shaped hole 82*b* formed in the boss 81. Because the shaft 89*a* is a member made of metal, the boss 81 would readily be damaged near the D-shaped hole 82*b* by the shaft 89*a* if the shaft 89*a* were to be stopped from rotating by only the D-shaped hole 82*b* formed in the resinous boss 81. However, because the metal washer 87 also contributes to the rotation stopping, damage to the boss 81 near the D-shaped hole 82*b* can be minimized.

In the outdoor fan 70 composed of this type of resinous axial-flow fan, it is preferable to sufficiently improve the connection strength between the hub 71 and the boss 81. Particularly, because the washer fitting part 83*a* herein is formed in the end surface 83 on the side of the boss 81 further from the fan motor 89, there is a portion of little thickness in the vicinity of the end surface 83 on the side of the boss 81 further from the fan motor 89. Therefore, in the outdoor fan 70, the connecting portion between the boss 81 and the inner perimeter edge of the lid 73 (the inner perimeter edge of the inner perimeter plate 73*c* herein) is likely to lose strength.

In view of this, in the outdoor fan 70, reinforcing ribs 74, 75 for reinforcing the connection between the hub 71 and the boss 81 are integrally resin-molded with the hub 71 and the boss 81 on both axial-direction sides of the lid 73. Outer perimeter reinforcing ribs 74 are ribs that connect the outer perimeter cylinder 72 and the lid 73 together. The outer perimeter reinforcing ribs 74 are formed on one axial-direction side of the lid 73 (the side further from the fan motor 89 herein), in a space S1 formed diametrally between the lid 73 and the outer perimeter cylinder 72. A plurality (six herein) of outer perimeter reinforcing ribs 74 are disposed at intervals in the circumferential direction. The outer perimeter reinforcing ribs 74 are plate-shaped members extending from the inner perimeter surface of the outer perimeter cylinder 72 toward a surface on one axial-direction side of the outer perimeter plate 73*a* of the lid 73 and toward the outer perimeter surface of the intermediate cylinder 73*b*. Inner perimeter reinforcing ribs 75 are ribs that connect the lid 73 and the boss 81 together. The inner perimeter reinforcing ribs 75 are formed on the other axial-direction side of the lid 73 (the side nearer to the fan motor 89 herein), in a space S2 formed diametrally between the boss 81 and the lid 73. A plurality (six herein) of inner perimeter reinforcing ribs 75 are disposed at intervals in the circumferential direction. The inner perimeter reinforcing ribs 75 are plate-shaped members extending from the inner perimeter surface of the intermediate cylinder 73*b* of the lid 73 and from the surface on the other axial-direction side of the inner perimeter plate 73*c*, toward the outer perimeter surface of the boss 81. The outer perimeter reinforcing ribs 74 are herein disposed between the inner perimeter reinforcing ribs 75 in the circumferential direction.

In an outdoor fan 70 of such description, reinforcing ribs 74, 75 are formed on both axial-direction sides of the lid 73 as described above, unlike a conventional axial-flow fan in which reinforcing ribs are formed on only one axial-direction side of the lid.

It is thereby possible in the outdoor fan 70 to strengthen the reinforcement between the hub 71 and the boss 81, and also to improve connection strength between the hub 71 and the boss 81, by means of the two types of reinforcing ribs 74, 75 formed on both axial-direction sides of the lid 73.

In the outdoor fan 70, the connecting portion between the boss 81 and the inner perimeter edge of the lid 73 is likely to lose strength as described above, while the reinforcement between the boss 81 and the lid 73 is strengthened by the inner perimeter reinforcing ribs 75 as described above.

Despite the connecting portion between the boss 81 and the inner perimeter edge of the lid 73 being likely to lose strength, it is thereby possible in the outdoor fan 70 to achieve sufficient connection strength between the boss 81 and the lid 73.

(3) Modification 1

Figure 8:
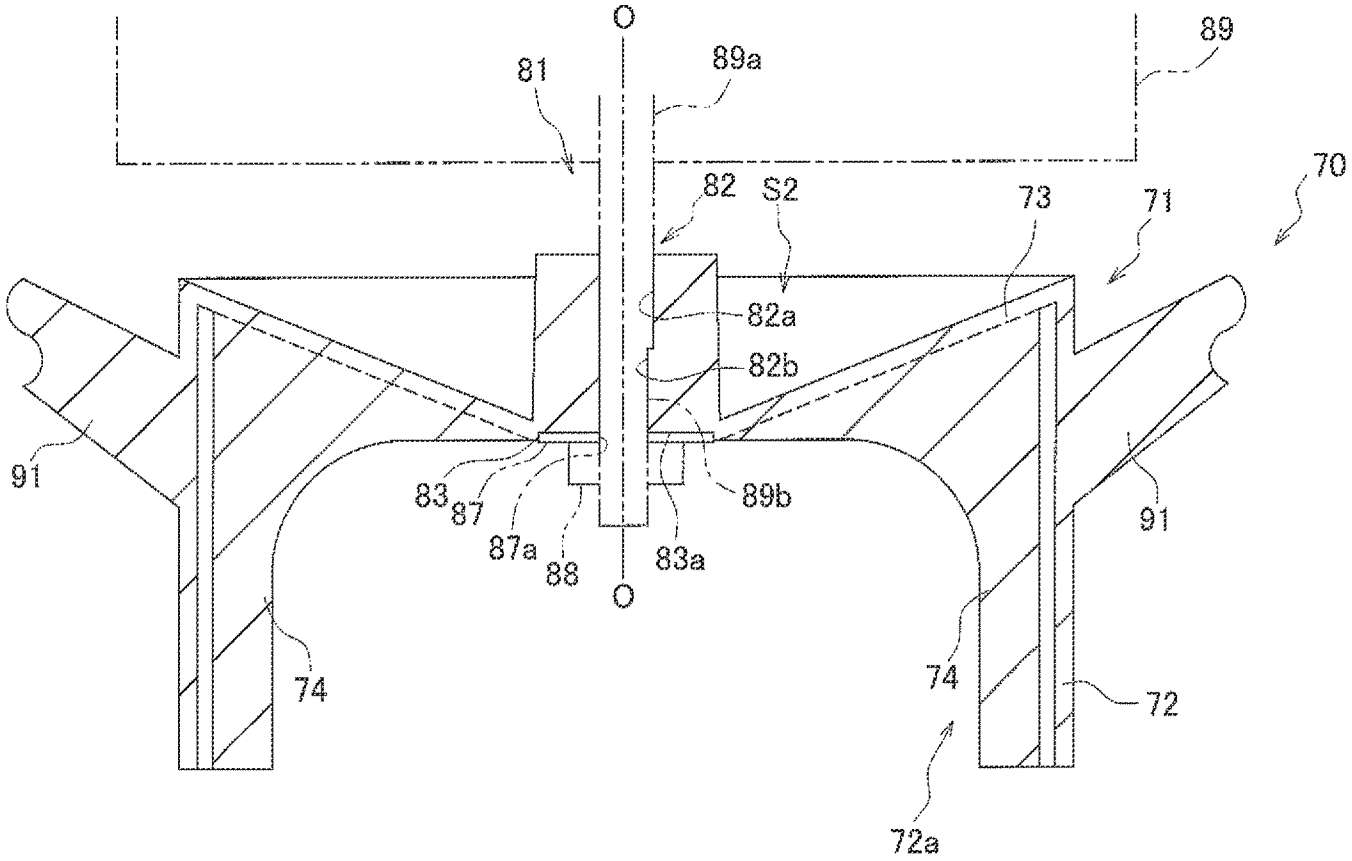
FIG. 8 is a cross-sectional view of an outdoor fan according to Modification 1, corresponding to FIG. 6.
Figure 9:
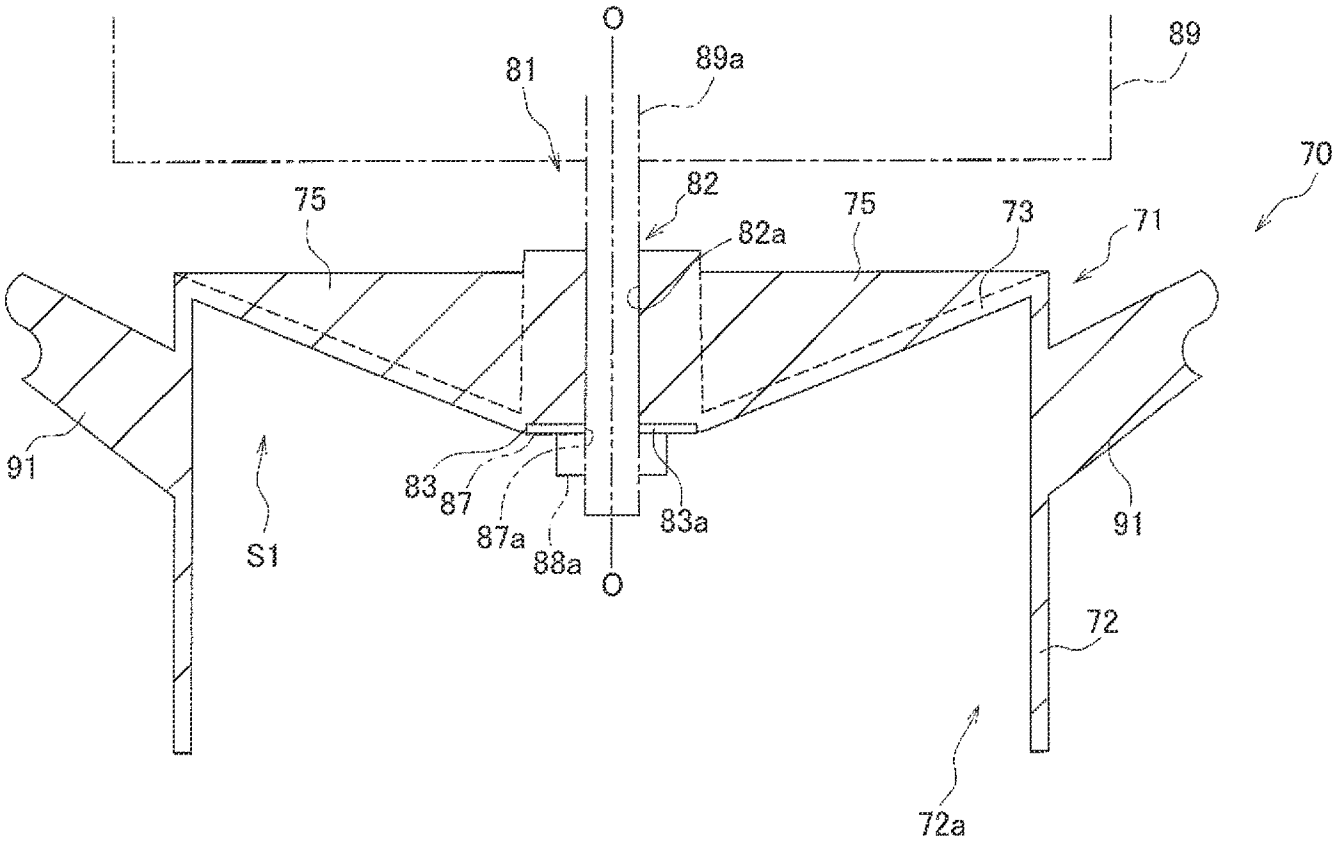
FIG. 9 is a cross-sectional view of the outdoor fan according to Modification 1, corresponding to FIG. 7.
Figure 10:
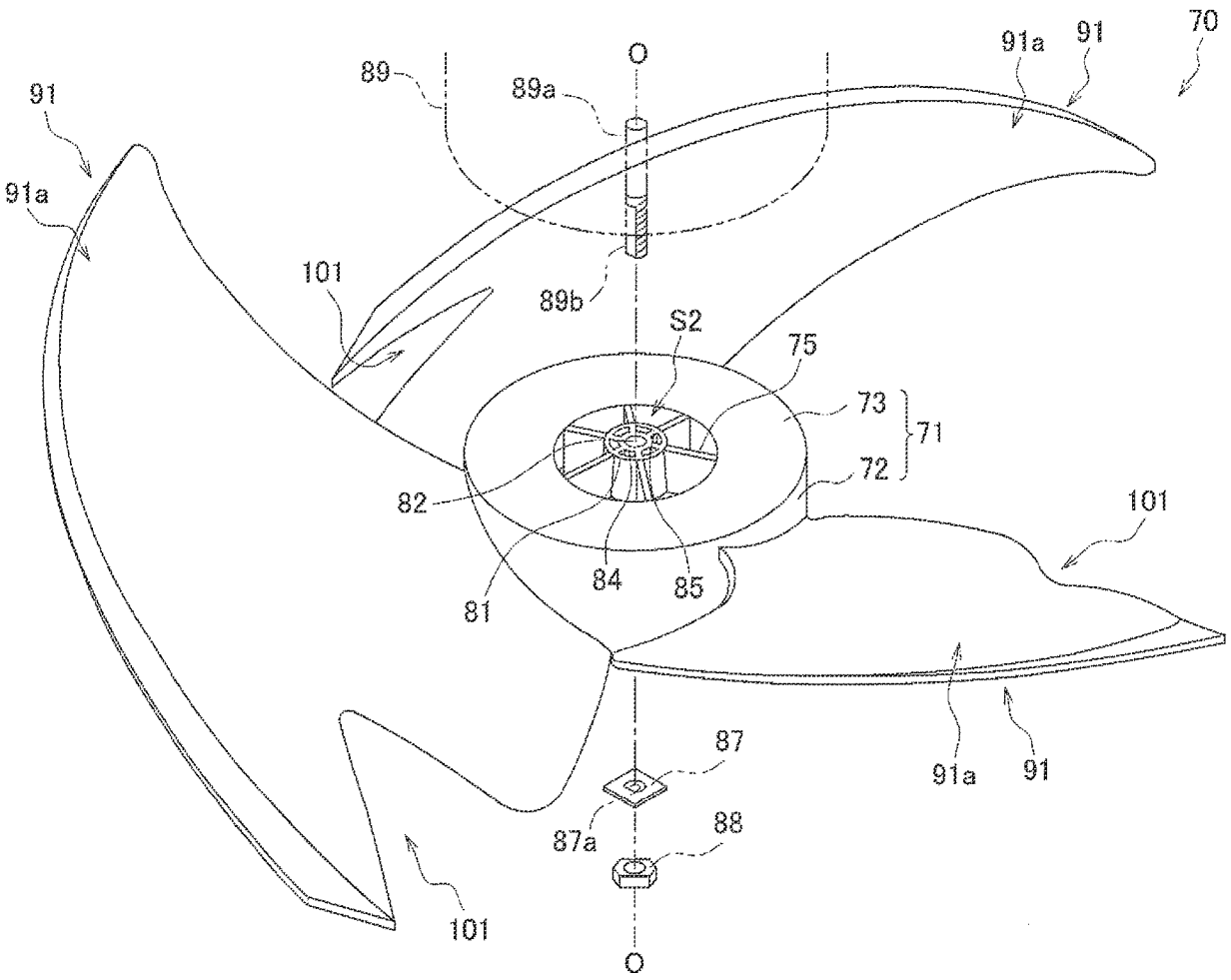
FIG. 10 is a perspective view of an outdoor fan according to Modification 2.
Figure 11:
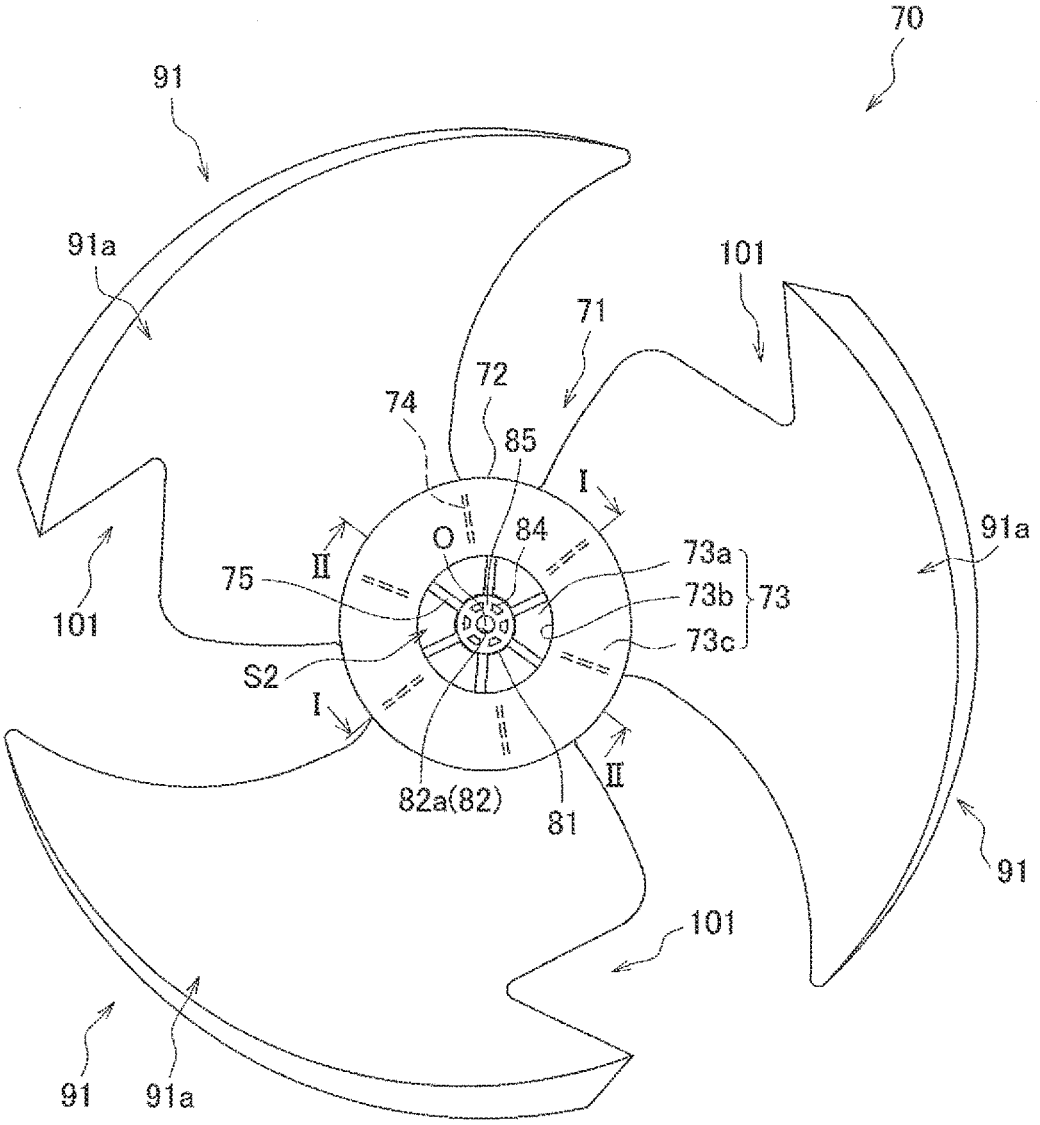
FIG. 11 is a plan view of a negative pressure surface side of the outdoor fan according to Modification 2.
Figure 12:
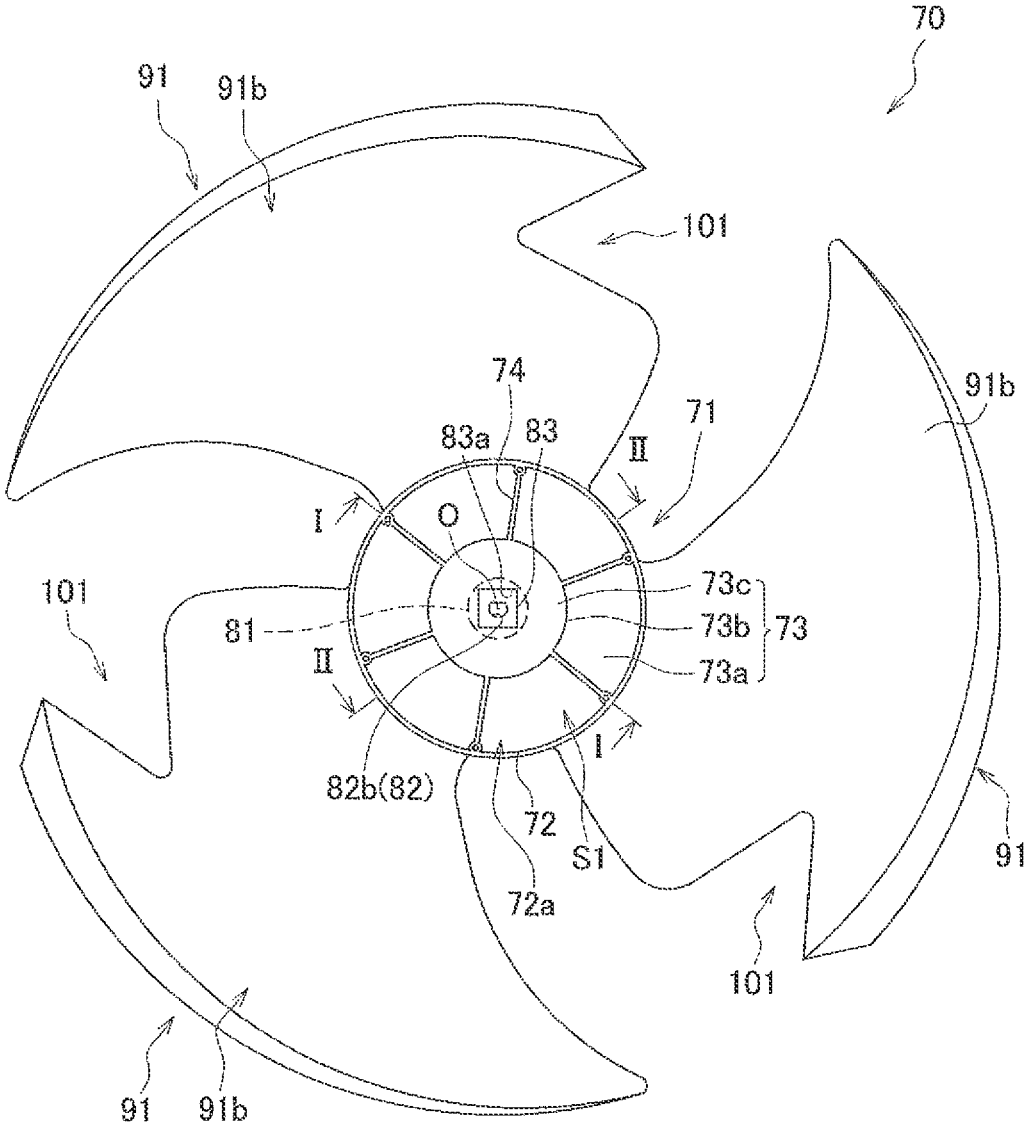
FIG. 12 is a plan view of a positive pressure surface side of the outdoor fan according to Modification 2.
Figure 13:
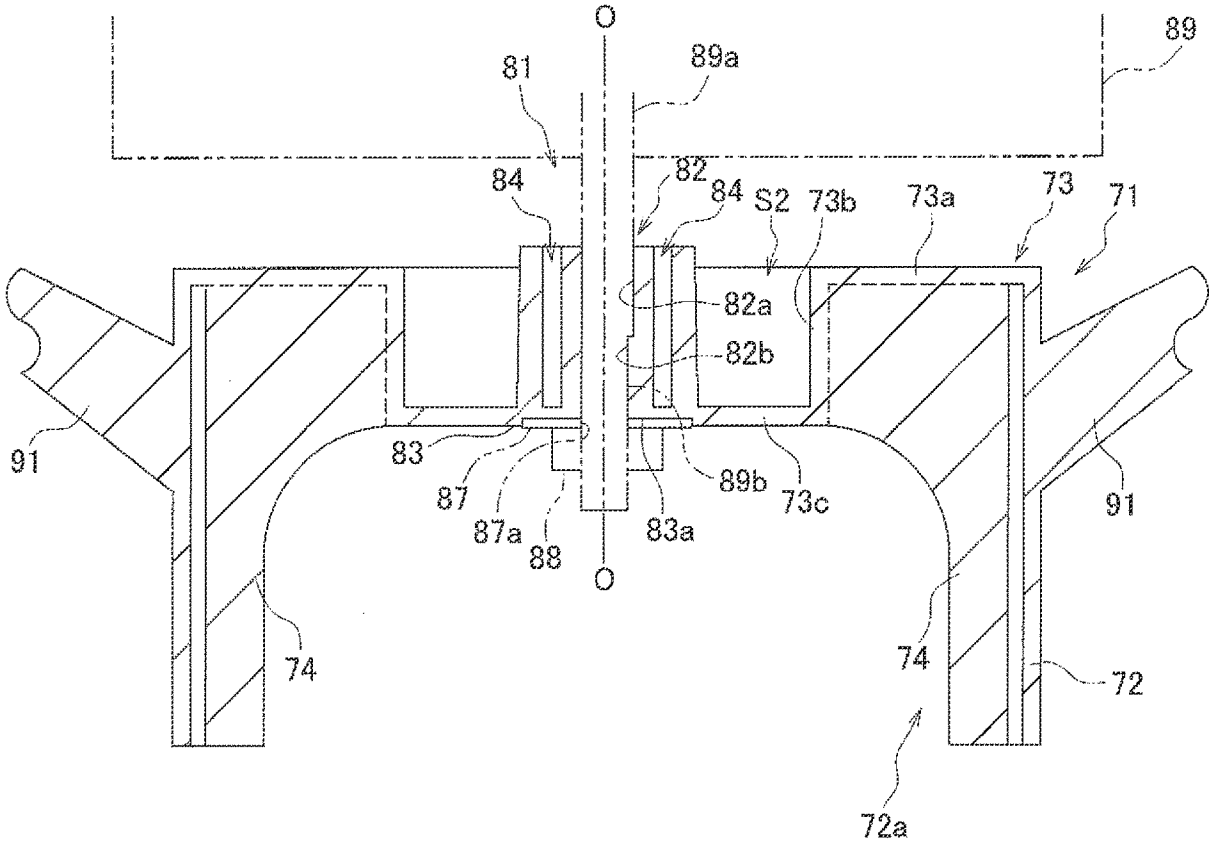
FIG. 13 is a cross-sectional view along line I-I in FIGS. 11 and 12.
Figure 14:
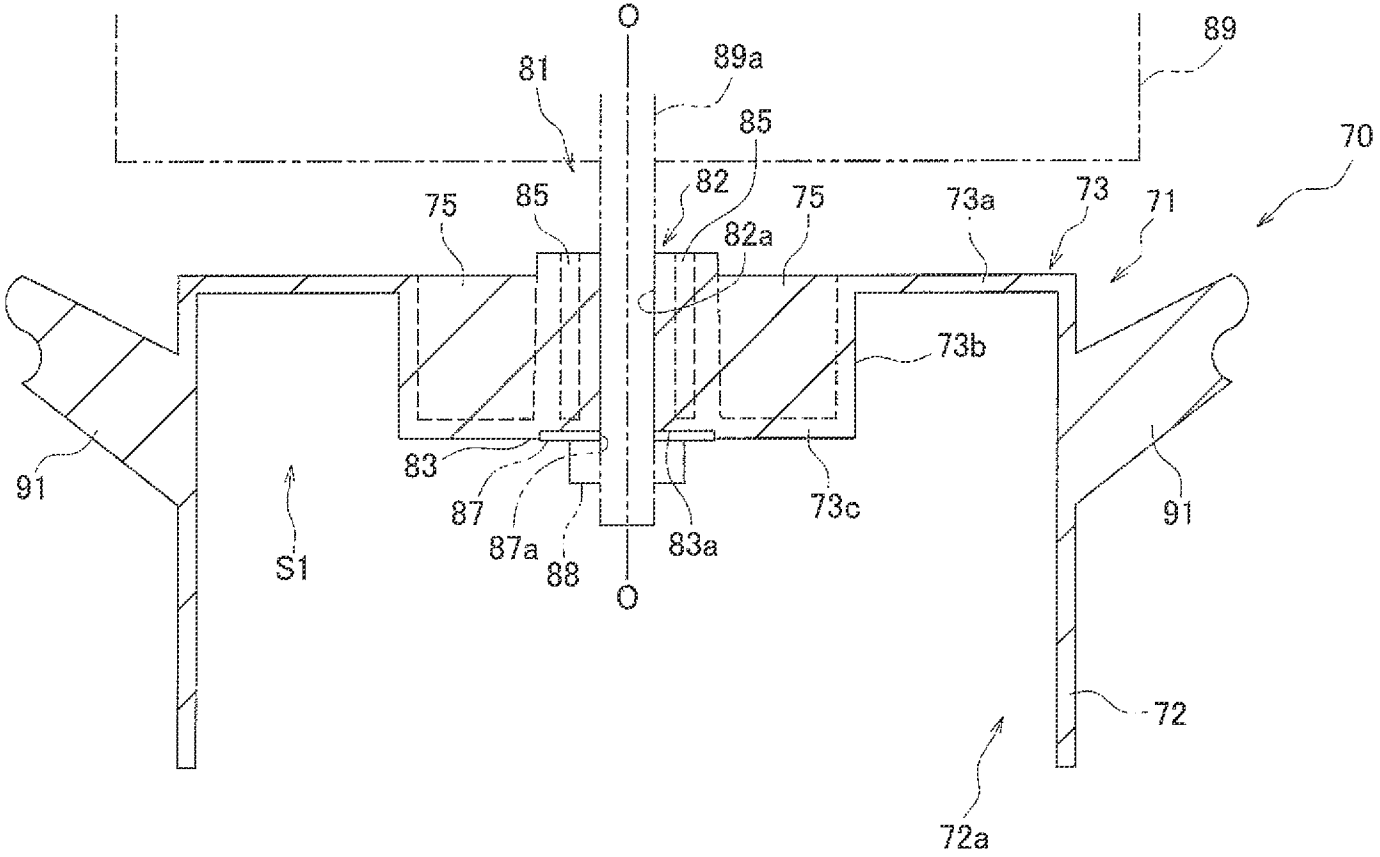
FIG. 14 is a cross-sectional view along line in FIGS. 11 and 12.

In the outdoor fan 70 of the above embodiment (see FIGS. 3 to 7), the lid 73 is configured so as to extend as a whole from the outer perimeter cylinder 72 toward the inner perimeter and in the axial direction, by the outer perimeter plate 73*a*, the intermediate cylinder 73*b*, and the inner perimeter plate 73*c*. However, the lid 73 is not limited to this configuration, and may be a portion that overall extends from the outer perimeter cylinder 72 toward the inner perimeter while inclining in the axial direction, as shown in FIGS. 8 and 9, for example. Thus, the lid 73 is not limited to the shape of the above embodiment, and may be shaped in various different ways.

(4) Modification 2

In the outdoor fans 70 of the above embodiment and Modification 1 (see FIGS. 3 to 9), it is preferable to provide a vibration-absorbing structure for minimizing noises caused by vibrations such as cogging sounds.

In view of this, in the outdoor fan 70 of the present modification, a thin-walled boss part 84 may be formed in the outer perimeter portion of the axial hole 82 of the boss 81 so that a plurality (six herein) of columnar ribs 85 are left, as shown in FIGS. 10 to 14.

In the outdoor fan 70 of the present modification, the transmission of vibrations such as cogging sounds from the boss 81 to the hub 71 can thereby be mitigated by the plurality of columnar ribs 85. Specifically, the plurality of columnar ribs 85 function as a vibration absorbing structure of the outdoor fan 70.

The columnar ribs 85 herein are disposed in the same circumferential direction positions as the inner perimeter reinforcing ribs 75. Therefore, in the outdoor fan 70 of the present modification, the columnar ribs 85 are designed to function together with the inner perimeter reinforcing ribs 75 as integrated reinforcing ribs for diametrally supporting the boss 81 and the lid 73.

In the outdoor fan 70 of the present modification, the boss 81 and the lid 73 can thereby be connected together more firmly.

Furthermore, the columnar ribs 85 are formed herein so as to not pass through the end surface 83 on the side of the boss 81 further from the fan motor 89.

In the outdoor fan 70 of the present modification, it is thereby possible to firmly connect the boss 81 and the lid 73 together and to install a vibration-absorbing structure while minimizing the loss of strength in the vicinity of the end surface 83 on the side of the boss 81 further from the fan motor 89.

In FIGS. 10 to 14, the thin-walled boss part 84 and the columnar ribs 85 are formed in the boss 81 of the outdoor fan 70 shown in FIGS. 3 to 7, but the thin-walled boss part 84 and the columnar ribs 85 may also be formed in the boss 81 of the outdoor fan 70 shown in FIGS. 8 and 9.

INDUSTRIAL APPLICABILITY

The present invention is widely applicable in an axial-flow fan in which a boss and a plurality of blades are integrally resin-molded with a hub, an axial hole through which a drive motor shaft is inserted being formed in the boss in the axial center of the hub.

What is claimed is:

1. An axial-flow fan comprising:

a boss having an axial hole formed therein; and a plurality of blades, the boss and the blades being integrally resin-molded with a hub, the axial hole being sized and configured to have a shaft of a drive motor inserted therein, and the axial hole being formed at an axial center of the hub, the hub including an outer perimeter cylinder having an opening formed at the axial center, the blades being formed so as to project from the outer perimeter cylinder, and a lid extending from the outer perimeter cylinder toward the boss so as to cover the opening of the outer perimeter cylinder, the lid connecting the boss and the outer perimeter cylinder together, and reinforcing ribs being integrally resin-molded together with the hub and the boss on both axial-direction sides of the lid, the reinforcing ribs being arranged and configured to reinforce a connection between the hub and the boss, the lid extending toward an inner perimeter and in an axial direction from the outer perimeter cylinder, the reinforcing ribs including outer perimeter reinforcing ribs connecting the outer perimeter cylinder and the lid together, and inner perimeter reinforcing ribs connecting the lid and the boss together the outer perimeter reinforcing ribs and the inner perimeter reinforcing ribs being disposed at intervals along a circumferential direction, and a thin-walled boss part being formed in an outer perimeter portion of the axial hole of the boss so that a plurality of columnar ribs are at intervals along the circumferential direction.

2. The axial-flow fan according to claim 1, wherein the boss extends from an inner perimeter edge of the lid toward a first of the axial-direction sides of the lid adjacent to the drive motor, and a washer fitting part is formed in an end surface of the boss on a second of the axial-direction sides of the lid opposite to the first of the axial-direction sides, and the washer fitting part includes a concavity sized and configured to receive a washer therein in order to stop rotation of the shaft.

3. The axial-flow fan according to claim 2, wherein the columnar ribs are disposed in circumferential direction positions the same as circumferential direction positions of the inner perimeter reinforcing ribs.

4. The axial-flow fan according to claim 3, wherein the outer perimeter reinforcing ribs are disposed between the inner perimeter reinforcing ribs along the circumferential direction.

5. The axial-flow fan according to claim 2, wherein the outer perimeter reinforcing ribs are disposed between the inner perimeter reinforcing ribs along the circumferential direction.

6. The axial-flow fan according to claim 1, wherein the columnar ribs are disposed in circumferential direction positions the same as circumferential direction positions of the inner perimeter reinforcing ribs.

7. The axial-flow fan according to claim 6, wherein the outer perimeter reinforcing ribs are disposed between the inner perimeter reinforcing ribs along the circumferential direction.

8. The axial-flow fan according to claim 1, wherein the outer perimeter reinforcing ribs are disposed between the inner perimeter reinforcing ribs along the circumferential direction.

* * * * *